United States Patent [19]

Novak

[11] 4,147,019

[45] Apr. 3, 1979

[54] METHOD AND APPARATUS FOR PRODUCING A DRAFTABLE TWISTED ROVING

[75] Inventor: Peter Novak, Winterthur, Switzerland

[73] Assignee: Rieter Machine Works, Ltd., Winterthur, Switzerland

[21] Appl. No.: 924,288

[22] Filed: Jul. 13, 1978

[30] Foreign Application Priority Data

Jul. 18, 1977 [CH] Switzerland ..... 8847/77

[51] Int. Cl.[2] ..... D01H 1/00; D01H 7/02; D01H 7/92

[52] U.S. Cl. ..... 57/66; 57/75; 57/124; 57/343; 57/348

[58] Field of Search ..... 57/66–72, 57/74, 75, 77.45, 118, 119, 122, 124, 125, 126, 51, 51.2, 51.6, 156

[56] References Cited

U.S. PATENT DOCUMENTS

| | | | |
|---|---|---|---|
| 743,139 | 11/1903 | Booth | 57/118 |
| 815,075 | 3/1906 | Doll | 57/74 |
| 1,174,961 | 3/1916 | Beede | 57/118 |
| 1,724,200 | 8/1929 | Hubbard | 57/66 |
| 1,838,682 | 12/1931 | Ingham | 57/74 |
| 2,131,893 | 10/1938 | Jessen | 57/75 X |
| 2,197,530 | 4/1940 | Purser et al. | 57/75 X |
| 3,106,055 | 10/1963 | Mackie | 57/58.59 |
| 3,724,195 | 4/1973 | Moore | 57/75 |
| 3,785,140 | 1/1974 | Muller | 57/119 X |

*Primary Examiner*—John Petrakes

*Attorney, Agent, or Firm*—Kenyon & Kenyon, Reilly, Carr & Chapin

[57] ABSTRACT

The supplied strand is provided with a permanent twist due to the rotating balloon and a superimposed false twist due to a false twist device prior to winding onto the bobbin package. Prior to winding on the package, the false twist is eliminated so that the resultant roving has relatively high breaking strength for handling purposes while remaining draftable.

The false twist device is located between the delivery rolls and spindle to rotate coaxially around the spindle and may be driven by the balloon or by a positive drive.

22 Claims, 15 Drawing Figures

METHOD AND APPARATUS FOR PRODUCING A DRAFTABLE TWISTED ROVING

This invention relates to a method and apparatus for producing a draftable twisted roving. More particularly, this invention relates to a method and apparatus for producing a draftable twisted roving on a rotating package.

Heretofore, it has been known to form a twisted roving consisting of staple fibers by imparting a twist in the fibers upon delivery onto a rotating package. A roving of this type is usually used in a cotton type spinning mill which is laid out in a conventional manner with roving or fly frames and ringspinning machines. In such mills, the roving is supplied as an input material for the last processing stage, i.e., for the ringspinning machine.

Rovings of this type must have a sufficient degree of breaking strength so that handling and, particularly, insertion of the roving into the drafting arrangement of the ringspinning machine does not cause uncontrolled drafts, i.e., mutual slippage or relative movement of the fibers in the strand of fibers. On the other hand, the roving must be draftable in such manner that the fiber mass can be reduced to the mass of the final yarn count. These two requirements are opposed as high breaking strength implies a high level of twist and poor draftability. Thus, compromise solutions have usually been chosen in which the amount of imparted twist is such that the roving remained just sufficiently draftable with care being taken to prevent the occurence of uncontrolled drafts.

The method which has been applied in practical use for producing a draftable, twisted roving which under impartion of twist is wound onto a rotating package consists in imparting twist to a continuously supplied input material consisting of parallel and substantially twist-free fibers by forming a balloon. The twist is then generated as a permanent or real twist by rotating the package (bobbin) while the delivery point of the fibers is stationary with respect to the room. The roving thus forms a rotating balloon between the stationary delivery point of the fibers and the rotating package, i.e., forms a roving loop rotating about the spindle axis.

The apparatus for implementing the known method is known as fly frame or roving frame, containing a drafting arrangement and a spindle supporting the rotating package (bobbin) as well as a flyer rotating coaxially with the spindle. The flyer is used for supporting the roving down to the winding point in such manner that the roving is not torn due to the lack of breaking strength under the influence of centrifugal force.

The necessity of using a flyer is a consequence of the above mentioned compromise between the twist imparted and the breaking strength. The flyer supports the roving in the balloon zone within a tube. Also, in bell-shaped flyers, i.e., in flyers which are closed along the whole circumference or along a substantial portion of the circumference, the conditions are similar.

The disadvantages of the known manufacturing method, and of the respective apparatus are obvious. The procedure is laid out in such manner that a compromise is chosen between a minimum of breaking strength of the roving to be maintained and a maximum breaking strength admissible for ensured draftability of the roving in such manner that the amount of twist to be inserted cannot be freely chose. Much more aggrevating, however, is the necessity of using a flyer, since this implies a number of disadvantages with respect to the apparatus. First, doffing of full roving packages from the spindle and donning new empty bobbin package tubes is rendered difficult. The flyer which surrounds the spindle on both sides from the top either must be lifted by hand off the spindle if supported thereon, or with an upper portion must be eliminated from the zone of the spindle axis, if the flyer, as a so-called suspended flyer, is supported in the upper portion. The flyer also can be constructed so long or high, respectively (i.e., practically twice as long as the bobbin tube itself) that the bobbin package must be lifted above the spindle and taken out from between the flyer legs. All these various flyer constructions result in complicated or difficult to operate machines, in which either the drafting arrangement is to be located at an excessively elevated position or on which the doffing of the full bobbin package is rendered difficult. Furthermore, such machines can hardly be automated at justifiable expense.

Further disadvantages of the conventional fly frames or roving frames are seen in the considerable wind generation produced by the great number of flyers per machine, usually arranged in two rows. This is very uncomfortable for the operators. Further, there is a risk of accidents presented by the rotating flyers. In order to eliminate these disadvantages, a complete enclosure of the working zone of the flyers by detachable covers has been tried. This, however, results in further impairment of the machine operability.

Accordingly, it is an object of the invention to eliminate the need for a flyer in forming a twisted roving.

It is another object of the invention to form a twisted roving of relatively high breaking strength which can be easily drafted.

It is another object of the invention to provide a relatively simple method of forming a twisted roving.

It is another object of the invention to provide an apparatus for forming a twisted roving which is relatively easy to operate.

It is another object of the invention to provide an apparatus for twisting roving in an automatic manner.

It is another object of the invention to provide an apparatus for producing twisted roving which is more productive than conventional fly frames or roving frames.

It is another object of the invention to provide a relatively high speed apparatus for producing twisted roving.

It is another object of the invention to reduce downtime periods in producing twisted draftable rovings.

Briefly, the invention provides a method of and apparatus for producing a twisted draftable roving of relatively high breaking strength.

The method includes the steps of supplying a continuous strand of parallel substantially twist free fibers from a delivery point to a rotating bobbin at a winding station at a predetermined speed, forming the strand into a freely rotating balloon about the bobbin between the delivery point and the winding station to impart a permanent twist in the strand, superimposing a false twist in the strand between the delivery point and a point upstream of the winding station so as to increase the twist and thereafter eliminating the false twist between the second point and winding station prior to winding the strand on the bobbin. Because the fiber strand is under the influence of the increased twist in the balloon, support of the roving by a flyer is no longer required.

In one embodiment of the method, the ratio a of the number of turns of permanent twist per unit length of the roving to the number of turns of false twist per unit length of the roving ranges from $0.5<a<10$, the preferred range being $1<a<3$.

Furthermore, a false twist level can be chosen so high, that in a breaking test of the roving, the individual fibers are broken rather than being slid apart in the roving.

The apparatus of the invention is comprised of a fiber supply device, a rotating spindle and a false twist device. The fiber supply device operates to continuously supply a strand of parallel substantially twist free fibers in the form of a small silver while the spindle mounts a bobbin thereon to form a roving package while rotating the supplied strand in a rotating balloon between the supply device and spindle. The false twist device is located between the supply device and spindle in the zone of the balloon for passage of the strand. This device is rotatable about the spindle to impart a falst twist in the strand between the supply device and false twist device.

The false twist device may be constructed in various forms and may be mounted in various manners to rotate about the spindle. For example, in one embodiment, the false twist device includes a rotatable tube having a bore for passage of the strand and a twist imparting means in the tube for engaging the strand. In one case, the tube may be disposed in parallel to the spindle while in other cases the tube may be disposed on an axis forming a right angle with the axis of the spindle.

In one embodiment, the false twist device is mounted on a freely rotatable support member which is disposed to rotate coaxially about the spindle under the influence of the rotating balloon. This is, the support member is set into rotation by the strand. In another embodiment, the support member is positively driven by a drive means coaxially about the spindle. A transmission is also provided for maintaining a predetermined speed ratio between the spindle and support member.

These and other objects and advantages of the invention will become more apparent from the following detailed description taken in conjunction with the following drawings in which:

FIG. 1 illustrates a schematic view of an apparatus operating according to the invention;

FIG. 2*a–c* illustrates a schematic indication on how twist is imparted according to the inventive method;

Figure 1:
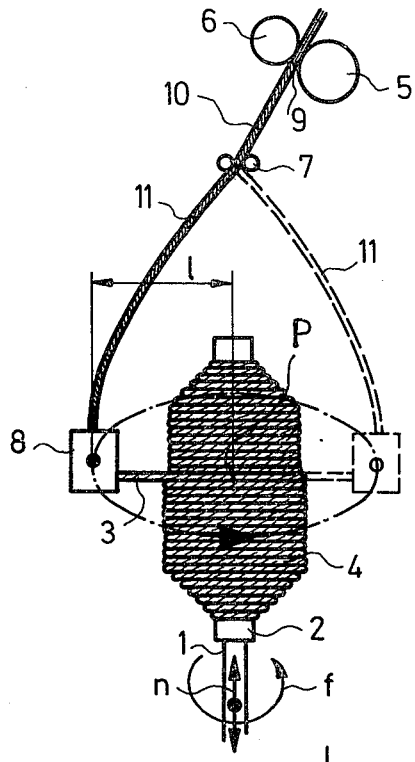

Referring to FIG. 1, the apparatus for producing a twisted draftable roving includes a rotatable spindle 1 which is able to perform a reciprocating up and down movement, the arrow f indicating the rotational movement and the double arrow n indicating the up and down movement. The spindle 1 is adapted to receive a bobbin tube 2 onto which a strand of fibers in the form of a roving 3 is wound, e.g., in the form of parallel windings generally used on fly frames or roving frames. The roving package produced is generally called a roving bobbin or spool. This package is of such type as to be creeled into a ring spinning machine (not shown). The roving contains a twist which lends a minimum breaking strength to the roving and maintains the roving draftable.

In addition, the apparatus includes a fiber supply device for continuously supplying a strand of parallel substantially twist-free fibers in the form of a small sliver 9. This device includes a pair of delivery rolls 5, 6 through which the strand is fed. The apparatus also has a roving guide 7 arranged coaxially with, and above, the spindle 1, and a false twist device 8, shown schematically only, which is located between the roving guide 7 and spindle to rotate coaxially about the spindle 1.

The delivery rolls 5, 6 can, for example, be the last rolls of a drafting arrangement of known type (not shown) which functions as a supply device. Other types of fiber supply devices can also be used, which fulfill the important requirement that an input material consisting of parallel and substantially twist-free fibers in the form of a small sliver 9 is continuously supplied.

Production of the roving 3 according to the inventive method is effected as follows:

The small silver 9 is continuously supplied by the delivery rolls 5, 6 and is twisted as twist is imparted. The resulting small twisted sliver 10 is then pulled through the roving guide 7 and forms, as seen in the direction of movement, a freely rotating balloon 11 while being pulled through the rotating false twist device 8 and delivered to a point P on the bobbin package 4. This type of formation of a free baloon 11 is known in practical spinning in the ultimate yarn spinning process on the ring spinning machine. (The term "free" in this context is understood as indicating the fact that the small twisted fiber sliver 10 is not supported radially in the path between the roving guide 7 and the false twist device 8).

Whereas the traveller on a conventional ring spinning machine performs the task of guiding the yarn along a circular path, the false twist device 8 performs the very important task of imparting a false twist to the small fiber sliver 9 emerging from the supply device. This false twist is superimposed on the true or permanent twist essentially generated by the spindle rotation. In this arrangement, care is taken that the permanent twist and the false twist are of the same sense. This is achieved by suitably choosing the direction of rotation of the spindle 1 and of the false twist device 8.

Figure 2C:
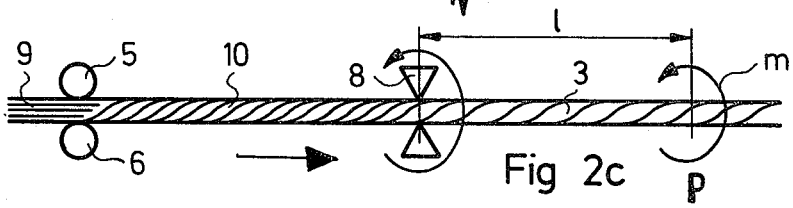
Figure 2B:
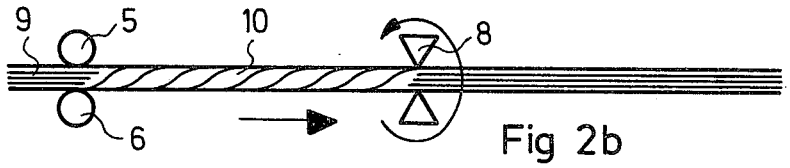
Figure 2A:
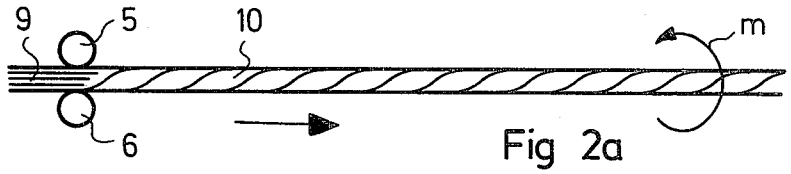

The twist relations are shown in a simplified, schematic view in FIGS. 2*a* through 2*c*. As shown, the twisted fiber sliver 9 contains a higher twist level along the path between the delivery rolls 5, 6 and the false twist device 8, due to the superimposition of the permanent twist and of the false twist, than the roving 3 after leaving the false twist device 8. Thus, as shown in FIG. 2*a*, the small twisted fiber sliver 10 has only the permanent twist generated by the rotation of the spindle 1. FIG. 2*b* shows the case of the false twist in which the fibers, upon leaving the false twist device 8, again are twist-free, i.e., are arranged exactly in the same manner as delivered by the delivery rolls 5, 6. FIG. 2*c* shows the superimposition of the permanent twist according to FIG. 2*a* and of the false twist according to FIG. 2*b* as generated by the apparatus according to FIG. 1. Thus, two twists of the same sense are superimposed on the path between the delivery rolls 5, 6 and the false twist device 8, i.e., just on the path corresponding to the zone of the free balloon. However, between the false twist device 8 and the bobbin 4, only the permanent twist remains in the roving 3.

By suitably chosing the level of the false twist, the total twist level in the balloon zone can be determined. The false twist-level, i.e., the number of turns imparted per roving unit length by the false twist device 8 is chosen such that the following is fulfilled:

$$0.5 < a < 10$$

where a is the ratio of the number of permanent or real turns per roving unit length to the number of false twist turns per unit length of roving. Experience has shown that a preferred ratio a fulfills the following relation:

$$1 < a < 3$$

The choice of the value of this ratio a depends on a large number of conditions, such as, e.g., the staple diagram of the material processed, on the fiber length, fiber type, fiber fineness, structure of the fiber surface. However, a is chosen such that in a breaking test of the roving subject to the superimposed two kinds of twist, the individual fibers are broken rather than sliding apart in the sliver. Thus, the occurrence of uncontrolled drafts in the zone of the balloon 11 in the roving can be avoided.

Figure 3:
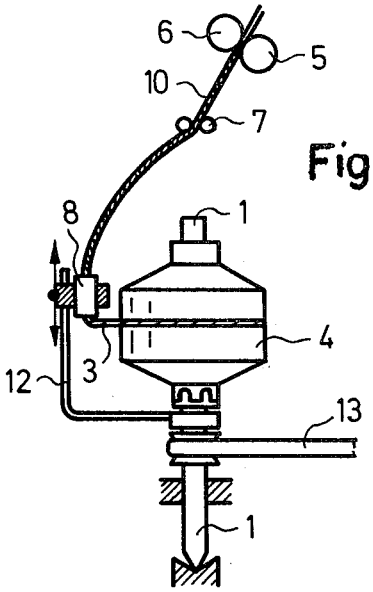
FIG. 3 illustrates a schematic view of an apparatus according to the invention.

Referring to FIG. 3, wherein like reference characters indicate like parts as above, the false twist device 8 can be dragged about the spindle 1 by the balloon 11 circling about the spindle 1. This arrangement corresponds in principle to a conventional ring/traveller combination as used on a ring spinning machine. In such a combination, the traveller is replaced by a false twist device 8 which is driven in any manner desired so as to impart additional false twist to the small fiber sliver 9. The false twist device 8 is supported on an arm 12, so as to perform an up and down traversing movement (controlled by means not shown) for the build-up of the roving package 4. The arm 12 is supported in a freely rotatable manner directly on the spindle 1, whereas the spindle 1 is rotated by a drive belt 13.

This arrangement has the advantage of simplicity as no controls are required between the bobbin package 4 and the false twist device 8 circling about the package 4. The roving 3 still containing the permanent twist and passing on to the point P in this zone, is required to show sufficient breaking strength, that under start-up condition, the false twist device 8 including the arm 12 can be accelerated, the bearing and air resistances being overcome.

Figure 4:
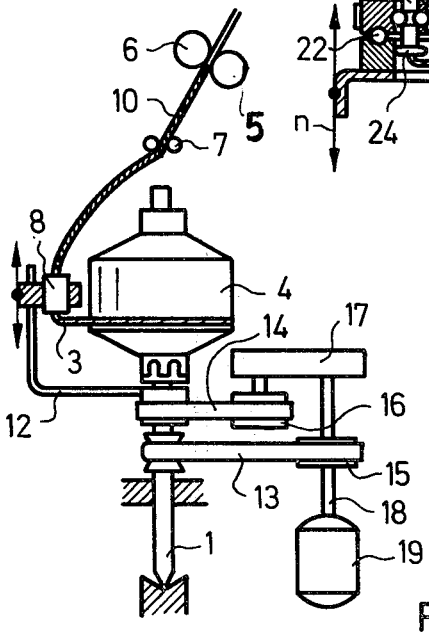
FIG. 4 illustrates a schematic view of an alternative apparatus according to the invention.

Referring to FIG. 4, the apparatus may alternatively be constructed so that the arm 12 which generally may be a support member rotating or circling coaxially about the spindle axis no longer is dragged but is positively driven by a drive means in the form of a second belt 14.

In order to maintain a predetermined speed ratio, i.e., the relative angular velocity ratio, between the spindle and the circling false twist device 8 as required, a transmission 17 in the form of a gear arrangement, i.e., an infinitely variable gear, connects a drive pulley 15 of the belt 13 and a drive pulley 16 of the belt 14. The drive pulley 15 is driven via a shaft 18 by an electrical motor 19. As above, during operation, the false twist device 8 imparts a false twist to the throughpassing roving 3, the lever of which is adjustable in relation to the level of permanent twist.

With reference to the examples mentioned below, various alternatives of the construction of the false twist device 8 are described in more detail.

Figure 5:
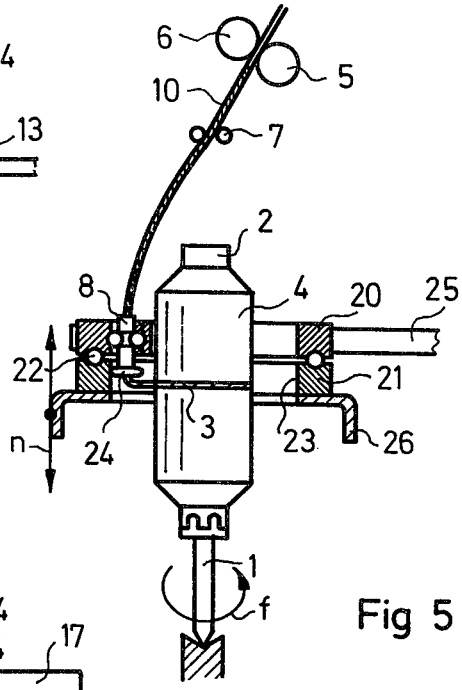
FIG. 5 illustrates a schematic view of a further alaternative embodiment of the apparatus.

Referring to FIG. 5, the support member supporting the false twist device 8 is shaped as a ring 20 which, in turn, is rotatably supported in a stationary support member 21, which does not rotate with respect to the room. The ring 20 is disposed to rotate coaxially with the spindle 1 in an anti-friction bearing 22. The support member 21 is provided with a cylindrical inside surface 23 which is coaxial with the spindle 1. The false twist device 8 is rotatably supported in the ring 20 and contains a rotating body 24 in the lower portion which contacts and rolls on the ring-shaped surface 23 of the support member 21. A positive rolling motion, e.g., using a gear arrangement also may be considered. A belt 25 is placed around the ring 20 to ensure that the ring 20 is set into rotation. Maintenance of a determined ratio between the rotational speed of the spindle 1 and the rotational speed of the ring 20 is ensured over the whole build-up of the bobbin 4 by a suitable means (not shown).

The support member 21 is arranged on a support 26 which performs an up and down traversing movement (indicated in FIG. 5 by the double arrow n) for winding the roving 3 onto the surface of the bobbin package 4.

Figure 6:
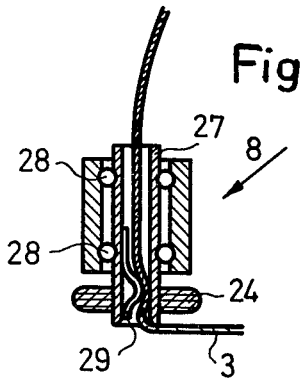
FIG. 6 illustrates a view of a false twist device applicable in the apparatus according to FIG. 5.

Referring to FIG. 6, the false twist device 8, such as applicable in the apparatus according to FIG. 5, comprises a tube 27 which is rotatably supported by anti-friction bearings 28 in the ring 20. The tube 27 is rigidly connected at the lower end with the rotating body 24. This rotating body 24 acts as a friction drive roll and preferentially is made from a material of high friction coefficient, e.g., from rubber. A sprng 29 inside the tube 27 presses the roving 3 against the inside tube wall and thus carries on the roving 3 in such manner that the roving 3 follows the rotation of the tube 27 about the tube axis; a false twist being imparted to the roving 3.

The false twist device according to FIG. 6 has proven to be a simple and reliable construction, any other suitable false twist device, however, can be used instead of the one described above.

Figure 7:
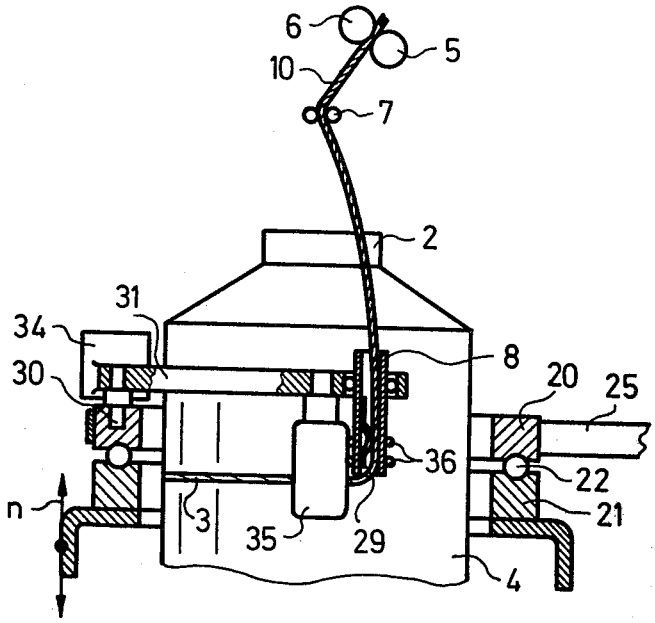
FIG. 7 illustrates a lateral view of a further alternative embodiment of an apparatus according to the invention.
Figure 8:
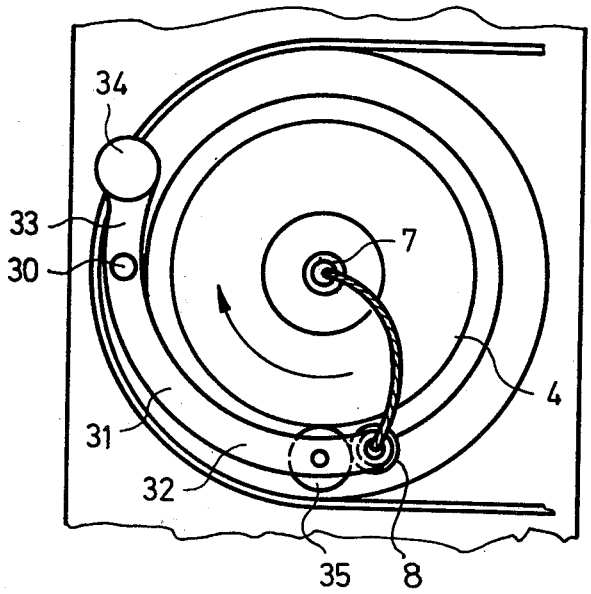
FIG. 8 illustrates a top view of the apparatus according to FIG. 7.

Referring to FIG. 7 and 8, wherein like reference characters indicate like parts as above, the apparatus may alternatively be constructed such that the ring 20 supports a fixed axle 30 which extends parallel to the spindle (not shown). As the ring 20 rotates, the axle 30 also moves circularly about the spindle. In addition, a double-armed lever 31 is pivotably supported on the axle 30. One arm 32 of the lever 31 supports the rotatably supported false twist device 8 at the free end along with a rotatable roll 35 while the second arm 33 carries a mass 34 at the free end. When the apparatus is in operation, the centrifugal force of the mass 34 forces the lever 31 with the roll 35, into contact with the surface of the bobbin 4. Because of the relative rotational movement of the bobbin 4 with respect to the ring 20 (which movement is required for winding the roving 3 onto the bobbin 4), the roll 35 is set into rotation via frictional contact with the bobbin package 4. The roll 35 and the false twist device 8 furthermore are arranged in such close vicinity on the lever arm 32 that they are in mutual contact with their cylindrical surfaces. For this purpose, the false twist device 8 can be provided with one or more rubber rings to ensure frictional contact. As the roll 35 rotates about its own axis, the roll 35 thus also drives the false twist device 8. The number of false twist turns per unit length imparted to the small twisted fiber sliver 10 can be suitably chosen by correspondingly choosing the diameter of the roll 35 and of the rubber rings 36.

The apparatus according to FIG. 7 has the advantage that the distance between the point at which the false twist is eliminated, i.e., the nip of the clamping spring 29 of the false twist device 8, and the point at which the roving 3 is wound onto the bobbin 4 (practically coinciding with the line of contact of the roll 35 and the bobbin 4) is kept very small. This arrangement thus is particularly well suited for processing short staple fiber material and rovings 3 at a very low level of permanent twist.

Figure 9:
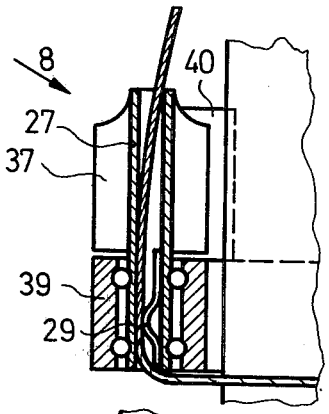
FIG. 9 illustrates a lateral view of a detail of a modified false twist device according to the invention.
Figure 10:
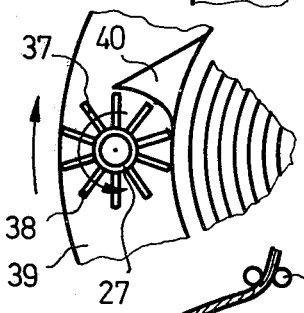
FIG. 10 illustrates a top view of the device according to FIG. 9.

Referring to FIGS. 9 and 10, wherein like reference characters indicate like parts as above, the false twist device 8 may alternatively be constructed to be set into rotation aerodynamically. For this purpose the tube 27 carries an air drive wheel 37 at the upper end with a number of blades 38 and is rotatably mounted in a support ring 39 which acts as a support member. As the ring 39 rotates, air forces are generated, which act on the air drive wheel 37 to set the wheel 37 into rotation. The air flow onto the blades 38 can be determined by arranging a suitably dimensioned guide body 40 on the ring 39 upstream from the air drive wheel 37 as seen in the direction of movement. In this arrangement, any separate drive mechanism for driving the false twist device 8, and in particular any frictional contact drive, can be eliminated.

Figure 11:
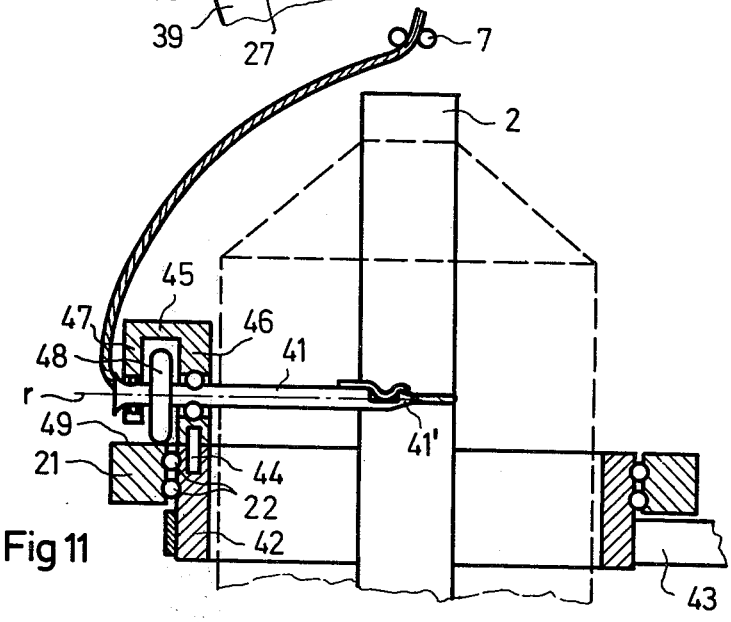
FIG. 11 illustrates a lateral view of a further alternative embodiment of an apparatus according to the invention, shown partially in a cross-section.

Referring to FIG. 11, the apparatus for producing a twisted roving may also be constructed in another manner to have a small distance between the point of elimination of the false twist and the point of winding on the bobbin. To this end, instead of the construction described with reference to FIGS. 7 and 8, this apparatus has a tube 41 for delivering the roving disposed on an axis r arranged in a plane substantially at right angles with respect to the spindle. As the spindle is arranged vertically, the tube 41 moves in a horizontal plane. Also, the support member 21 supports an inner ring 42 via antifriction bearings 22 which ring 42 is set into rotation via a belt 43. A vertical axle 44 is arranged in the inner ring 42 to pivotally support a U-shaped support member 45. This member 45 has two legs 46, 47 in which the tube 41 is rotatably supported in an anti-friction bearing each. The tube 41 also carries a rotatable body 48 at the end most distant from the bobbin tube 2. During the rotation of the ring 42 and of the connected support member 45, the body 48 rolls on a stationary horizontal surface 49 of the support member 21.

The tube 41 which has a bore for passage of the roving is pressed, by means (not shown) with a pointed end 41' against the surface of the building bobbin package. Because of the pivot mounting about the axis 44, the tube 41 remains adjacent the bobbin package 4 at all times while the bobbin diameter increases. The rotating body 48, thus, at times, does not perform a pure rolling movement but also has a radial sliding component.

This construction (FIG. 11) has the advantage over the construction shown in FIGS. 7 and 8 that the vertical extent or height of the apparatus can be kept compact.

Figure 12:
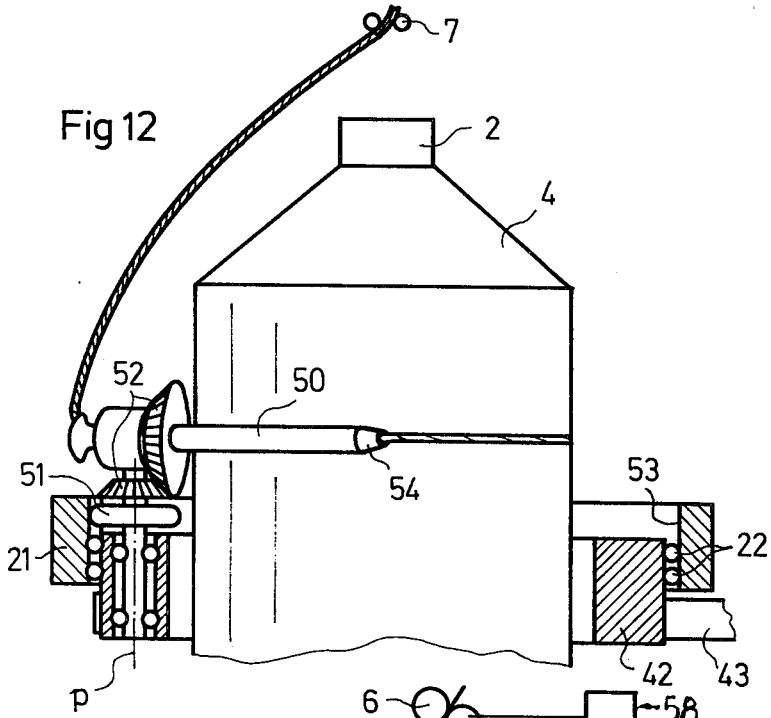
FIG. 12 illustrates an alternative embodiment of the apparatus according to FIG. 11, also shown partially in a cross-section.

Referring to FIG. 12, in order to eliminate the radial sliding component of the movement of the rotating body 48, a bevel gear arrangement 52 can be provided between the rotating body 51 and the tube 50 such that the rotating body 51 can rotate about a vertical axis p. In this embodiment, the rotating body 51 is directly supported and rotatable in the ring 42, and can perform a pure rolling movement on a cylindrical inside surface 53 of the support member 21. Also, just as in the apparatus according to FIG. 11, a suitable means (not shown) is provided for pressing the pointed end 54 of the tube 50 against the surface of the bobbin 4 at all times.

Figure 13:
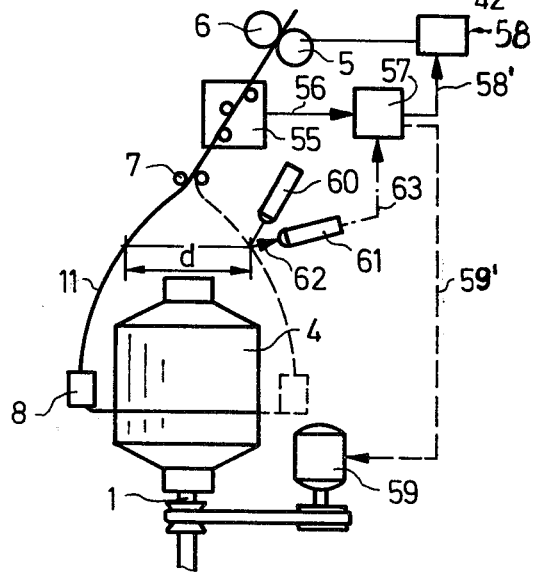
FIG. 13 illustrates a schematic view of an apparatus having control means for controlling the speed of operation in accordance with the invention.

Referring to FIG. 13, the apparatus for producing a twisted draftable roving may also be constructed with a means to adjust the ratio of the delivery speed of the input material and/or of the rotating speed of the bobbin. This adjusting or controlling means is used for maintaining optimum working conditions, which can be either maintaining the tension of the roving constant and/or the control of the geometrical form of the balloon, e.g., of the maximum balloon diameter.

In the first case, the tension of the roving between the delivery rolls 5, 6 and the roving guide 7, i.e., in a zone where the small twisted fiber sliver 10 is still subject to false twist, is measured by a tension gauge 55, such as is known in practical spinning mill use. The tension gauge 55 is adapted to transmit an electrical signal via a circuit 56 to a comparator 57, where the value measured is compared with the preset value of the desired tension. In addition, a means in the form of a drive 58 is provided for controlling the speed of the delivery rolls 5,6 of the fiber supply device and a means in the form of a drive 59 is provided for controlling the speed of the spindle 1. The drive 58 of the delivery rolls 5,6 is controlled via a circuit 58' from the comparator 57 and the drive 59 of the spindle 1, or the rotational speed of the bobbin 4 respectively, is controlled via a circuit 59' from the comparator 57 in such manner, that the tension value measured by the tension gauge 55 remains constant. That is, the drives 58, 59 are responsive to the measurements of the gauge 55 so that the speed of the rolls 5,6 is reduced and/or the speed of the spindle 1 is increased in response to a decrease in measured tension and vice versa in response to an increase in measured tension.

In similar manner, the shape of the freely rotating balloon 11, which always depends on the roving tension, can be determined and can be used for effecting the above-mentioned control. For this purpose, e.g., the outline of the balloon 11 along a certain diameter d (FIG. 13) is measured by a contact free gauge, e.g., by a photo cell, consisting of a light emitter 60 and a light receiver 61. The light beam 62 emitted by the light emitter 60 is reflected by the surface of the balloon 11 and meets the receiver 61. Any change of the diameter d thus is registered immediately and an electrical signal is transmitted via a circuit 63 to the comparator 57. The comparator 57 in turn takes care, in the same manner as described above, of the control of the delivery speed of the input material via the drive 58 of the delivery rolls 5,6 and/or of the rotational speed of the bobbin 4 via the drive 59 of the spindle 1.

The advantages of the inventive method and apparatus are summarized as follows:

(a) No flyer is required. Operation of the apparatus is thus considerably simplified, particularly the exchange of full bobbin packages for empty bobbin tubes. It is also possible to automate the exchange or doffing process without complication.

(b) Low wind generation and reduced danger of accidents. The working conditions are thus improved for the operators. Enclosure of the working elements, particularly the flyers, which are expensive and time consuming for the operators, can be eliminated.

(c) The machine height can be kept low as compared to known roving frame types, as the problem of moving the bobbin package out of the flyer no longer exists. Also, this represents an improvement of the machine operability.

(d) The bobbin packages produced are of higher density than conventional bobbins, as such a breaking strength can be generated in the roving in the freely rotating balloon that the roving also can be wound up under high tension. Thus, more compact bobbin packages are produced, i.e., bobbins of higher density. This also rationalises operation, especially transport of the bobbins.

(e) No large masses are to be traversed up and down, as it is sufficient to move the false twist device and, if applicable, a light weight drive for the device. The machine thus can be constructed in a relatively light-weight manner.

(f) Fewer roving breakages, as the roving is very strong in the balloon zone. Furthermore, there is no more danger of uncontrolled drafts.

All these advantages as a whole yield a more productive machine, the efficiency of which is clearly higher than the efficiency of a conventional fly or roving frame.

What is claimed is:

1. A method of producing a twisted draftable roving comprising the steps of supplying a continuous strand of parallel substantially twist free fibers from a delivery point of a rotating bobbin at a winding station at a predetermined speed;

forming the supplied strand into a freely rotating balloon about the bobbin between said delivery point and said winding station to impart a permanent twist in the strand therebetween;

superimposing a false twist in the strand between said delivery point and a second point upstream of said winding station to increase the twist in the strand between said points; and thereafter eliminating said false twist in the strand between said second point and said winding station prior to winding of the strand onto the bobbin at said winding station wherein the distance between said second point and said winding station is smaller than the length at which the roving still containing the permanent twist slides apart under tension, whereby a twisted draftable roving is formed into a package on the bobbin.

2. A method as set forth in claim 1 wherein the ratio (a) of the number of turns per unit length of roving of permanent twist and to the number of turns per unit length of roving of false twist is in the range of from greater than 0.5 to less than 10.

3. A method as set forth in claim 2 wherein said ratio is in the range of from greater than 1 to less than 3.

4. A method as set forth in claim 1 wherein said false twist is sufficient to impart a breaking strength to the twisted roving to cause the individual fibers thereof to break rather than to slide apart in a breaking test.

5. A method as set forth in claim 1 which further comprises the steps of measuring the tension in the strand between said first and second points and controlling at least one of the predetermined speed of supply of the strand and the rotational speed of the bobbin in response to the measured tension.

6. A method as set forth in claim 1 which further comprises the steps of controlling at least one of the predetermined speed of supply of the strand and the rotational speed of the bobbin to maintain the diameter of the outline of the freely rotating balloon constant.

7. An apparatus for producing a twisted draftable roving comprising a fiber supply device for continuously supplying a strand of parallel substantially twist-free fibers in the form of a small sliver;

a rotating spindle for mounting of a bobbin tube thereon to receive the supplied strand thereon to form a roving package while forming the supplied strand in a rotating balloon coaxially of said spindle between said supply device and said spindle; and a false twist device between said supply device and said spindle in the zone of said balloon for passage of the strand therethrough, said false twist device being rotatable about said spindle to impart a false twist in the supplied strand between said devices.

8. An apparatus as set forth in claim 7 which further comprises a freely rotatably support member disposed to rotate coaxially about said spindle, said support member having said false twist device mounted thereon whereby said member is set into rotation by the strand in said rotating balloon.

9. An apparatus as set forth in claim 7 which further comprises a support member for supporting said false twist device thereon, a drive means for rotating said support member coaxially about said spindle and a transmission for maintaining a predetermined speed ratio between said spindle and said support member.

10. An apparatus as set forth in claim 8 or claim 9 wherein said support member includes a non-rotatable support and a rotatable ring rotatably mounted on said support.

11. An apparatus as set forth in claim 10 wherein said support includes an annular surface coaxially of said spindle and wherein said false twist device includes a rotatable body rollably contacting said annular surface for driving said false twist element on said annular surface.

12. An apparatus as set forth in claim 11 wherein said rotatably body frictionally contacts said annular surface.

13. An apparatus as set forth in claim 10 wherein said support member further includes an axle on said rotatable ring parallel to said spindle; a double-armed lever pivotally supported on said axle, said lever having said false twist device mounted on one arm thereof; and a mass mounted on the other arm thereof whereby upon rotation of said ring, said one arm is pressed against the roving package under the influence of centrifugal force.

14. An apparatus as set forth in claim 13 wherein said false twist device includes a rotatable tube having a bore parallel to said spindle for passage of the strand therethrough, a twist imparting means in said tube for engaging the strand, and means in driving contact with said rotatable tube and the roving package for rotating said rotatable tube about a longitudinal axis thereof.

15. An apparatus as set forth in claim 8 or claim 9 wherein said false twist element includes a rotatable air drive wheel, said wheel being rotated under air forces generated during rotation of said support member about said spindle.

16. An apparatus as set forth in claim 8 or claim 9 wherein said support member includes a non-rotatable support having a cylindrical annular surface coaxially of said spindle and a rotatable ring rotatably mounted on said support; and wherein said false twist device includes a rotatable tube on an axis forming a right angle with an axis of said spindle and having a bore for passage of the strand therethrough, a twist imparting means in said tube for engaging the strand, a rotatable body rollably contacting said annular surface for driving said false twist element on said annular surface, said body being disposed on an axis parallel to said spindle, and a bevel gear arrangement between said body and said rotatable tube for maintaining said tube adjacent the roving package during rotation of said false twist element.

17. An apparatus as set forth in claim 7 wherein said false twist device includes a rotatable tube having a bore for passage of the strand therethrough and a twist imparting means in said tube for engaging the strand.

18. An apparatus as set forth in claim 17 wherein said tube is disposed on an axis forming a right angle with an axis of said spindle.

19. An apparatus as set forth in claim 7 which further comprises a tension gauge for measuring the tension in the strand in the balloon and means for controlling the speed of at least one of said fiber supply device and said spindle; said means being responsive to the measurements of said gauge whereby said speed of said supply device is reduced and said speed of said spindle is increased in response to a decrease in measured tension and vice versa in response to an increase in measured tension.

20. An apparatus as set forth in claim 7 which further comprises a gauge for measuring the diameter of the balloon and means for controlling the speed of at least one of said fiber supply device and said spindle; said means being responsive to the measurements of said gauge whereby said speed of said supply device is reduced and said speed of said spindle is increased in response to a decrease in measured diameter and vice versa in response to an increase in measured diameter.

21. An apparatus as set forth in claim 20 wherein said gauge measures the balloon without contact therewith.

22. An apparatus as set forth in claim 21 wherein said gauge includes a photocell having a light beam reflected by the balloon during rotation.

* * * * *